US008714812B2

(12) United States Patent
Aoki

(10) Patent No.: US 8,714,812 B2
(45) Date of Patent: May 6, 2014

(54) ELECTRONIC TIMEPIECE

(75) Inventor: Nobuhiro Aoki, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 489 days.

(21) Appl. No.: 13/083,909

(22) Filed: Apr. 11, 2011

(65) Prior Publication Data

US 2011/0249538 A1 Oct. 13, 2011

(30) Foreign Application Priority Data

Apr. 12, 2010 (JP) ..... 2010-091090
Apr. 12, 2010 (JP) ..... 2010-091111

(51) Int. Cl.
*G04C 9/00* (2006.01)

(52) U.S. Cl.
USPC ..... 368/187; 368/184

(58) Field of Classification Search
USPC ..... 368/187–189, 184, 185–186
See application file for complete search history.

(56) References Cited

U.S. PATENT DOCUMENTS

| | | | | |
|---|---|---|---|---|
| 7,859,952 | B2 * | 12/2010 | Aoki | 368/80 |
| 7,961,557 | B2 * | 6/2011 | Fujii et al. | 368/80 |
| 8,023,362 | B2 * | 9/2011 | Suizu et al. | 368/81 |
| 8,467,274 | B2 * | 6/2013 | Aoki | 368/80 |

FOREIGN PATENT DOCUMENTS

| | | |
|---|---|---|
| JP | 2006-284444 | 10/2006 |
| JP | 2009-085674 | 4/2009 |

OTHER PUBLICATIONS

Japanese Office Action for Japanese Application No. 2010-091090 mailed on Feb. 7, 2012.

* cited by examiner

*Primary Examiner* — Sean Kayes
(74) *Attorney, Agent, or Firm* — Amin, Turocy & Watson, LLP

(57) ABSTRACT

Disclosed is an electronic timepiece, comprising: a second hand and a minute hand; a stepping motor which performs a stepping drive of the hands; a rotating body which includes a target section, and rotates with the second hand; a detection section which detects an existence of the target section; a detection control section which makes the detection section operate by every rotation period, to make the detection section detect the existence of the target section at a first timing and at a second timing; a hand position counter which counts estimated positions of the hands based on the number of drive times of the stepping motor; a counted value holding section capable of temporarily holding a value of the hand position counter; a counted value saving section which makes the counted value holding section hold the value; and a counted value correcting section which corrects the value.

9 Claims, 13 Drawing Sheets

ELECTRONIC TIMEPIECE

CROSS-REFERENCE TO RELATED APPLICATIONS

This application is based upon and claims the benefit of priority under 35 USC 119 of Japanese Patent Application Nos. 2010-091090 and 2010-091111 both filed on Apr. 12, 2010, the entire disclosure of which, including the description, claims, drawings, and abstract, is incorporated herein by reference.

BACKGROUND OF THE INVENTION

1. Field of the Invention

The present invention relates to an electronic timepiece displaying time with hands and being equipped with a hand position detecting mechanism.

2. Description of Related Art

In an electronic timepiece driving its hands with a stepping motor, for example, if a strong magnet is situated in the vicinity of the electronic timepiece, the rotor of the stepping motor does sometimes not rotate although drive pulses are supplied, and the hands are not driven.

An electronic timepiece equipped with a function of detecting the positions of its hands has conventionally been proposed (see, for example, Japanese Patent Application Laid-Open Publication No. 2009-085674), which timepiece detected the positions by forming a penetration hole in each of the gears rotating in conjunction with the hands, respectively, and setting the penetration holes to appear at a detection position when the hands were situated at a predetermined position to detect the penetration holes with a photointerrupter or the like and thereby to detect the positions of the hands.

The hand position detecting mechanism disclosed in Japanese Patent Application Laid-Open Publication No. 2009-085674 has been capable of performing the position detection of the hands only once for an hour at the time of an ordinary hand movement. For example, even if a positional shift of its second hand has been caused, the positional shift has sometimes not been capable of being detected for a long time nearly to one hour or so forth.

Moreover, if the hand position detecting mechanism is adapted to execute hand position detection every one second or every two seconds in order to detect the positional shift of the second hand, then the hand position detecting mechanism produces a problem in which the number of times of detection becomes very large and excessive electric power is consumed.

Moreover, if the hand position detecting mechanism is adapted to execute the hand position detection only at the timing at which the penetration holes of the gears appear at the detection position, then a situation in which it is impossible to detect a stopped state of the hands when the hands are stopped at the detection position owing to an external factor (for example, a strong magnet) arises.

Moreover, some electronic timepieces each include a hand position counter therein to count the rotation positions of their hands on the basis of the number of drive times of each of their stepping motors besides their timing counters. In an electronic timepiece displaying information other than time with its hands temporarily and an electronic timepiece performing the detection and correction of the positional shifts of its hands, the hands sometimes move to positions different from those at the present time, such electronic timepieces each need also the hand position counter besides the timing counter.

When the hands are abnormally stopped owing to an external factor (for example, a strong magnet), the value of the hand position counter continues to be counted up every output of a drive pulse that brings about a presumption that the stepping motor has been driven, and consequently the value of the hand position counter gradually becomes apart from the value indicating the real hand positions.

In such a case, the value of the hand position counter can correctly be corrected at the time of a restart of a normal hand movement by previously counting the number of times of the detection of hand stops from the detection time of an abnormal stop of the hands to the next detection of the normal hand movement. That is, the value of the hand position counter can be corrected to a value indicating the real hand positions by subtracting the counted value for the number of times of the detection of hand stops from the value of the hand position counter at the time point of the detection of the normal hand movement.

However, an abnormal stop of the hands will sometimes extend over a long period of time, for example, in the case where an electronic timepiece is left as it is in the neighborhood of a strong magnet. In this case, if the number of times of the detection of hand stops is counted, the counted value will sometimes become a very large value. A counter having a relatively large number of bits (e.g. a storage region of a random access memory (RAM)) must be prepared for counting the number of times of the detection of hand stops in order to deal with such a long term hand stop. A counter having a small number of bits would overflow when the abnormal stop of the hands extends over a long period of time, and consequently the value of the hand position counter would become incapable of correcting the value normally.

The present invention provides an electronic timepiece capable of rapidly detecting the occurrence of a situation of a positional shift or an abnormal stop of a second hand, capable of reducing the number of times of detection operations to achieve a reduction of power consumption, and capable of easily correcting the value of a hand position counter when the rotation of the second hand stops without counting the number of times of the detection of hand stops and without needing a counter having a large number of bits.

SUMMARY OF THE INVENTION

According to an aspect of the present invention, there is provided an electronic timepiece, comprising:

a second hand and a minute hand; a stepping motor which performs a stepping drive of the second hand and the minute hand in conjunction with each other;

a rotating body which includes a target section, and rotates in conjunction with the second hand in one of rotation periods equal to, twice of, and half of a rotation period of the second hand;

a detection section which detects an existence of the target section at a predetermined detection position;

a detection control section which makes the detection section operate by every rotation period of the rotating body, so as to make the detection section detect the existence of the target section at a first timing at which the target section is supposed to appear at the detection position and at a second timing at which the target section is supposed to hide from a state of being situated at the detection position;

a hand position counter which counts estimated positions of the second hand and the minute hand based on the number of drive times of the stepping motor;

a counted value holding section capable of temporarily holding a value of the hand position counter;

a counted value saving section which makes the counted value holding section hold the value of the hand position counter when whether or not the secondhand is normally rotating is examined by detecting the existence of the target section with the detection control section and when a lack of the rotation of the second hand is detected; and a counted value correcting section which corrects the value of the hand position counter based on the value held in the counted value holding section, when the rotation of the second hand is detected with the detection control section and the lack of the rotation of the second hand is detected.

DESCRIPTION OF THE PREFERRED EMBODIMENT

In the following, an embodiment of the present invention will be described with reference to the accompanying drawings.

Figure 1:
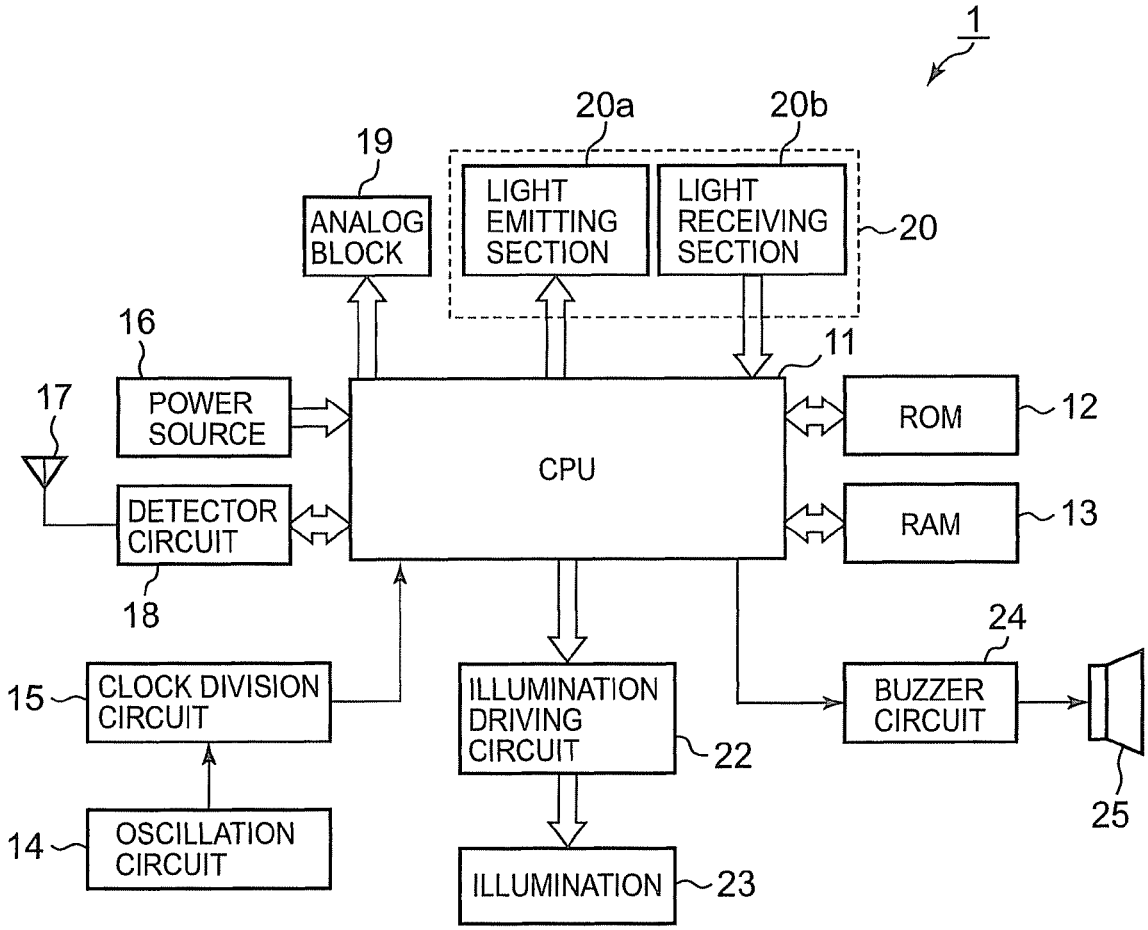
FIG. 1 is a block diagram showing the whole of an electronic timepiece of an embodiment of the present invention.
Figure 2:
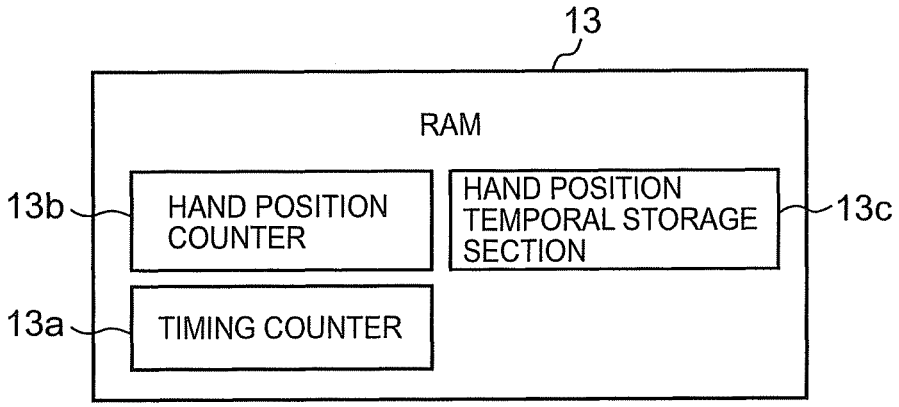
FIG. 2 is a diagram showing counters and a data storing section formed in a RAM.

FIG. 1 is a block diagram showing the whole of the electronic timepiece of the embodiment of the present invention, and FIG. 2 is a diagram showing the counters and a data storing section formed on the RAM of the embodiment.

Figure 8A:
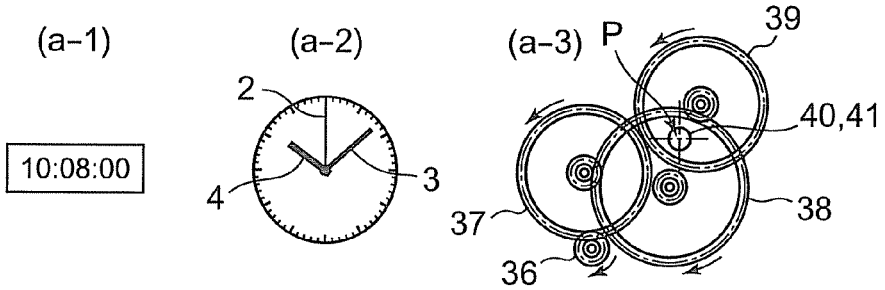
FIGS. 8A, 8B, 8C, 8D and 8E are a first part of explanatory views showing an operation of a hand position examination at the time of a normal hand movement.
Figure 8B:
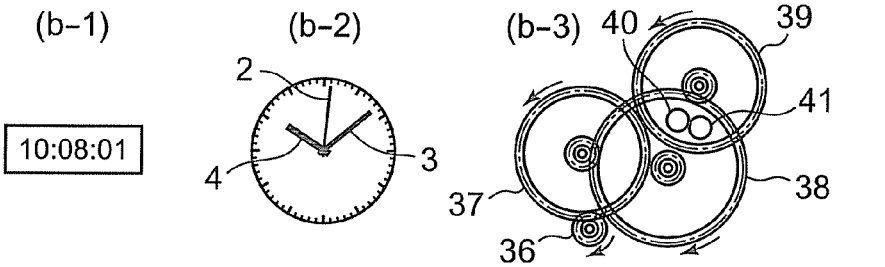

The electronic timepiece 1 of this embodiment displays time by rotating a second hand 2, a minute hand 3, and an hour hand 4 (see FIG. 8A) above a number plate. As shown in FIG. 1, the electronic timepiece 1 includes a central processing unit (CPU) 11 performing the whole control of the timepiece 1; an analog block 19 including the plurality of hands (the second hand 2, the minute hand 3, and the hour hand 4) and a mechanism driving these hands 2, 3, and 4 to rotate them; a photodetector 20 performing position detection of the second hand 2; a read only memory (ROM) 12 storing control programs executed by the CPU 11 and control data; a random access memory (RAM) 13 providing the CPU 11 with a working memory space; a power source section 16 supplying each section with an operating voltage; an antenna 17 and a detector circuit 18 for receiving a standard wave for time correction; an oscillation circuit 14 and a clock division circuit 15 for supplying the CPU 11 with a signal of a predetermined frequency; an illumination section 23 and an illumination driving circuit 22 for illuminating the number plate; a speaker 25 and a buzzer circuit 24 for performing an alarm output; and the like.

The analog block 19 includes the second hand 2, the minute hand 3, the hour hand 4, a stepping motor interlocking these hands 2-4 with one another to perform a stepping drive of them, a train wheel mechanism 30 (see FIG. 3) transmitting a rotational motion of the rotor of the stepping motor to the second hand 2, the minute hand 3, and the hour hand 4 by their respective predetermined rotation speed ratios, and the like.

The stepping motor is supplied with drive pulses from the CPU 11 to rotate the rotor by the step of, e.g., 180°. The stepping motor is configured to generate rotations within the range of from 0° to 180° or the range of from 180° to 360° in accordance with the polarities of the drive pulses. A rotation of the rotor to move the second hand 2 to a position of an odd second within the range of from 0° to 180° will be referred to as an odd step; a rotation of the rotor to move the second hand 2 to a position of an even second within the range of from 180° to 360° will be referred to as an even step; a drive pulse of the polarity of producing a rotation of an odd step will be referred to as an odd pulse; a drive pulse of the polarity of producing a rotation of an even step will be referred to as an even pulse.

The RAM 13 includes at its predetermined regions a timing counter 13*a* counted up by the CPU 11 on the basis of a divided frequency signal from the clock division circuit 15 to hold the time data indicating the present time; a hand position counter 13*b* counted up by the CPU 11 on the basis of the number of the drive times of the stepping motor to hold the number of hand position steps indicating the present positions of the second hand 2, the minute hand 3, and the hour hand 4; and a hand position temporal storage section 13*c* (counted value holding section) capable of temporarily holding the value (at least the value of hours and minutes by the time scale) of the hand position counter 13*b*.

The electronic timepiece 1 of this embodiment is configured to interlock the three hands including the second hand 2, the minute hand 3, and the hour hand 4 with one another to rotate them with one stepping motor. The electronic timepiece 1 is, furthermore, configured in such a way that the second hand 2 makes one revolution per minute by 60 steps; the minutes hand 3 makes one revolution per 60 minutes; and the hour hand 4 makes one revolution per 12 hours. The hand position counter 13*b*, consequently, results in storing counted values indicating "0" to " $(60\times60\times12)-1=43199$" according to the number of drive steps of the second hand 2, the minute hand 3, and the hour hand 4.

Figure 3:
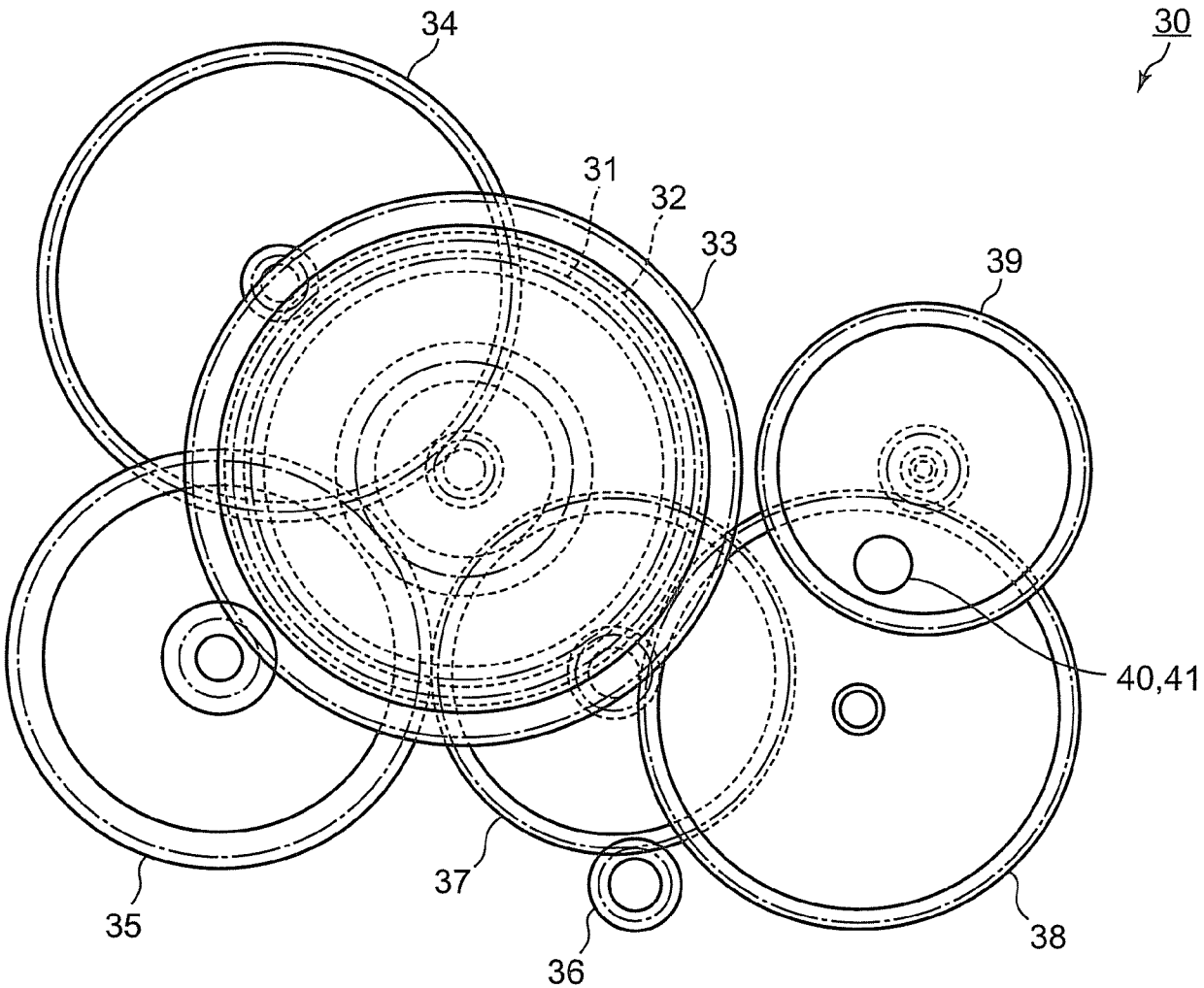
FIG. 3 is a front view showing a train wheel mechanism included in the analog block of FIG. 1.

FIG. 3 shows a front view showing the train wheel mechanism 30, included in the analog block 19 of FIG. 1, and FIG.

4 shows a sectional view showing an arrangement relation among a first detection wheel, a second detection wheel, and the photodetector 20.

The train wheel mechanism 30 is composed of a plurality of gears including a second hand wheel 31, to which the second hand 2 is adhered with a connecting shaft put between them; a minute hand wheel 32, to which the minute hand 3 is adhered with a hollow connecting shaft put between them; an hour hand wheel 33, to which the hour hand 4 is adhered with a hollow connecting shaft put between them; a third wheel 34 transmitting the rotation of the second hand wheel 31 to the minute hand wheel 32 at a rotation speed ratio of "60:1"; a minute wheel 35 transmitting the rotation of the minute hand wheel 32 to the hour hand wheel 33 at a rotation speed ratio of "12:1"; a drive wheel 36 adhered to the rotor of the stepping motor; a fifth wheel 37 transmitting the rotation of the drive wheel 36 to the second hand wheel 31 at a rotation speed ratio of "30:1"; a first detection wheel 38 (rotating body) rotating at the same rotation speed ratio as that of the second hand wheel 31 to be used for the position detection of the second hand 2; and a second detection wheel 39 for exposing the penetration hole 40 of the first detection wheel 38 only at a necessary step position.

The second hand wheel 31, the minute hand wheel 32, and the hour hand wheel 33 are arranged in such a way that their respective rotating shafts overlap one another on the same shaft line. Then, the train wheel mechanism 30 is configured in such a way that the hollow connecting shaft of the minute hand 3 is inserted into that of the hour hand 4; the connecting shaft of the second hand 2 is inserted into the hollow connecting shaft of the minute hand 3; and these three connecting shafts each rotate on the same shaft line to be configured to transmit these rotations to the second hand 2, the minute hand 3, and the hour hand 4, respectively.

The penetration hole 40 as a section to be detected (a target section) is formed in the first detection wheel 38. The penetration hole 40 is, for example, a through-hole transmitting light therethrough, and the other parts of the first detection wheel 38 is configured to intercept light. A penetration hole 41 is formed in the second detection wheel 39 at a radial position overlapping that of the penetration hole 40 of the first detection wheel 38. The penetration hole 41 is, for example, a through-hole transmitting light therethrough, and the other parts of the second detection wheel 39 is configured to intercept light. The second detection wheel 39 rotates by a relatively large rotation angle, such as 36°, when the first detection wheel 38 rotates by one step (6°). Thereby, when the second hand 2 reaches a detection position (e.g. "00" second position), the two penetration holes 40 and 41 overlap each other at the detection position P (see FIG. 9D "i-3"). On the other hand, when the second hand 2 is situated at a step position before or after the detection position P, the penetration hole 41 of the second detection wheel 39 is largely shifted to be a state in which the penetration hole 40 of the first detection wheel 38 is not exposed at the detection position P (see FIG. 9C "h-3" and FIG. 9E "j-3"). Hence, the train wheel mechanism 30 is configured in such a way that the penetration hole 40 is exposed at the detection position P only by a predetermined step and is hidden from the detection position P before and after the detection position P although the first detection wheel 38 rotates only by a small rotation angle (e.g.6°).

Figure 4:
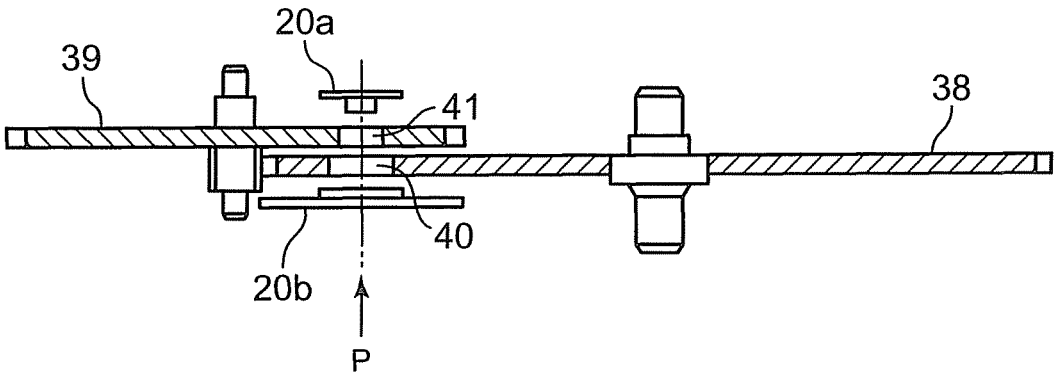
FIG. 4 is a sectional view showing an arrangement relation between a first detection wheel, a second detection wheel, and a photodetector.

The photodetector 20 (detection section) is composed of a light emitting section 20*a*, such as a light emitting diode, and a light receiving section 20*b*, such as a phototransistor. These light emitting section 20*a* and light receiving section 20*b* are fixed onto the bearing plate of the electronic timepiece 1 with the first detection wheel 38 and the second detection wheel 39 put between the sections 20*a* and 20*b*. As shown in FIG. 4, the photodetector 20 is configured in such a way that a light emitted from the light emitting section 20*a* passes through the penetration holes 40 and 41 to be received by the light receiving section 20*b* when the penetration holes 40 and 41 overlap each other at the detection position P.

The ROM 12 stores a timing processing program for counting up the timing counter 13*a* to update time data on the basis of a signal from the clock division circuit 15; a time display processing program for driving the stepping motor at the time of a carry of one second in synchronization with the time data of the timing counter 13*a* to thereby display time with the plurality of hands 2, 3, and 4; a hand position counting processing program for counting up the hand position counter 13*b* to update hand position data along with the drive of the stepping motor; a hand position examining processing program for examining whether delays or abnormal stops of the hands 2, 3, and 4 have arisen or not at the time of a carry of one minute in synchronization with the time data of the timing counter 13*a*; and the like; as the control programs to be executed by the CPU 11.

Next, the hand position examining processing to be executed in the electronic timepiece 1 having the configuration described above will be described with reference to flow charts and explanatory views.

Figure 5:
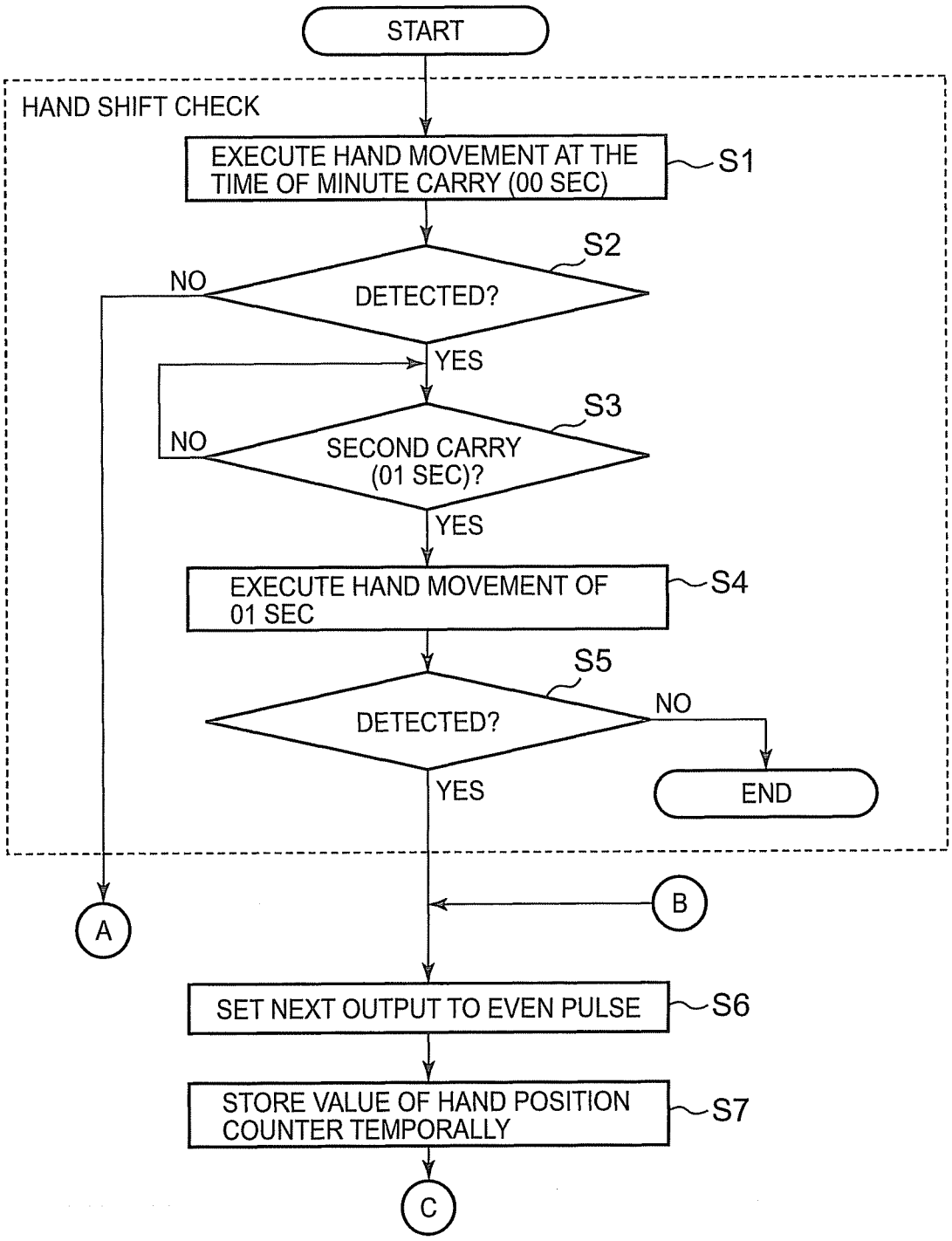
FIG. 5 is a first part of a flow chart showing a control procedure of hand position examining processing executed by a central processing unit (CPU)
Figure 6:
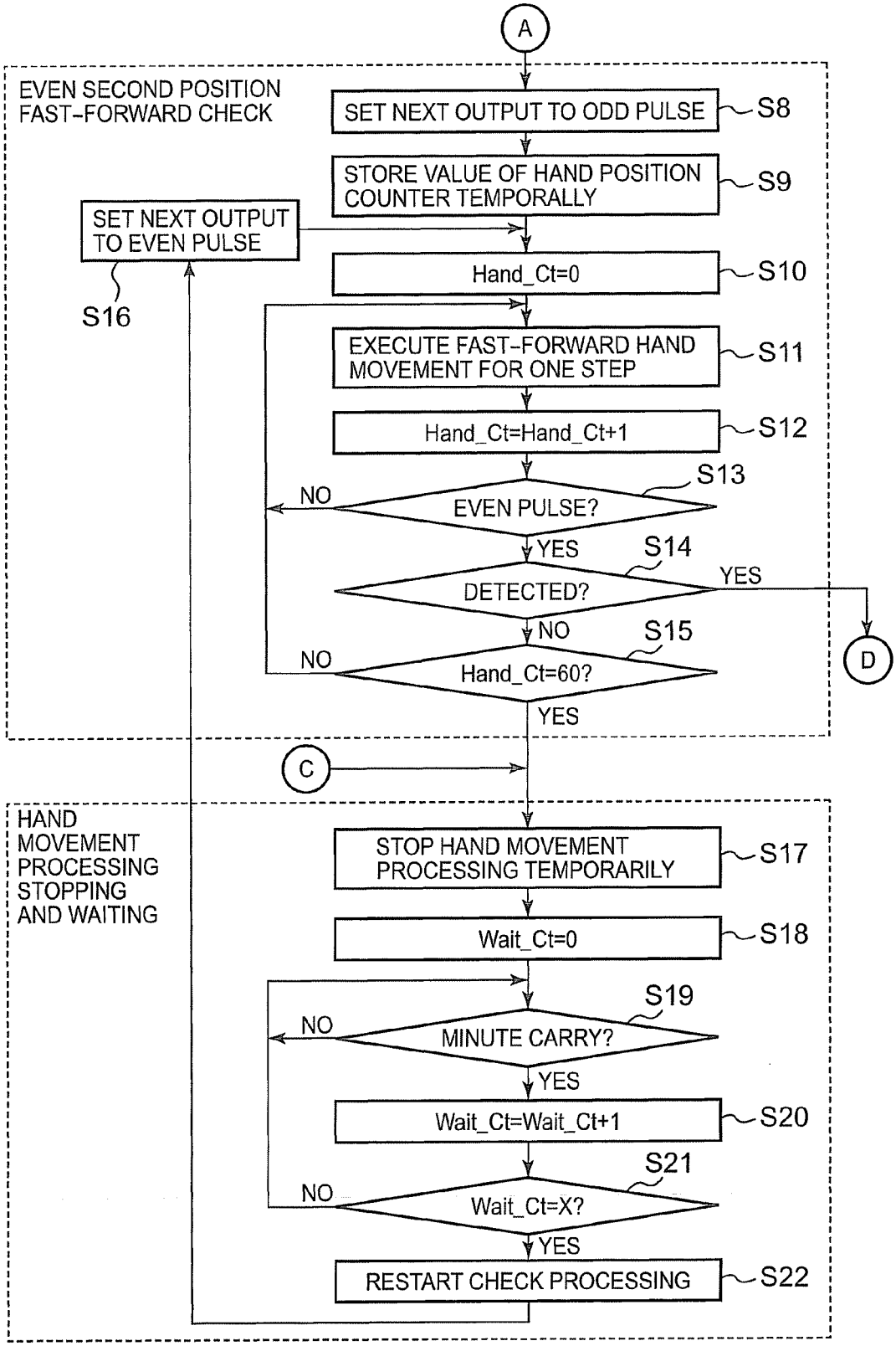
FIG. 6 is a second part of the flowchart showing the same hand position examining processing.
Figure 7:
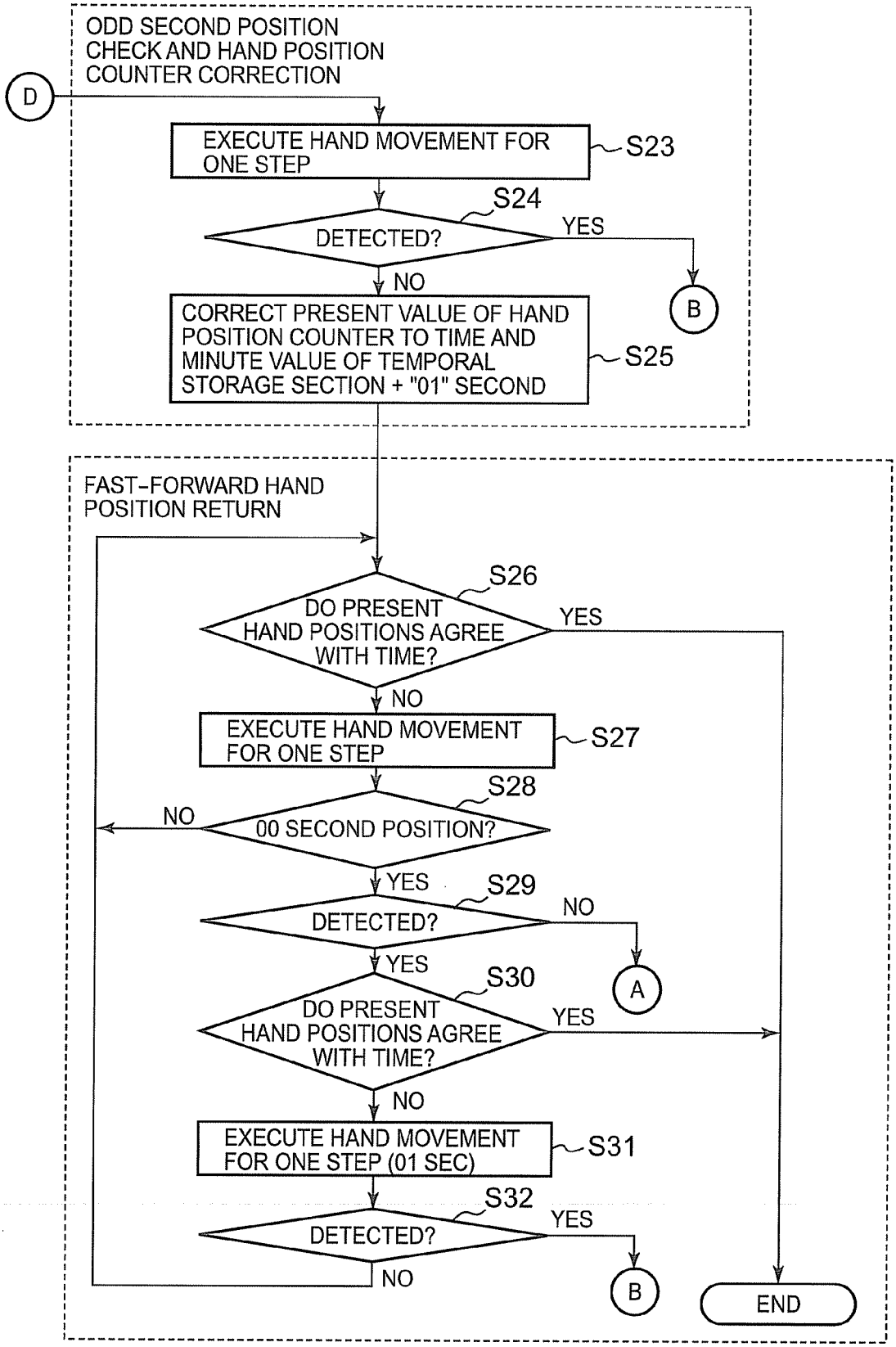
FIG. 7 is a third part of the flow chart showing the same hand position examining processing.

FIGS. 5-7 are flow charts showing the control procedure of the hand position examining processing to be executed by the CPU 11. FIGS. 8A-14E are explanatory views showing the operation contents of the electronic timepiece 1 at the time of the hand position examining processing.

In FIGS. 8A-13E, "a-1"-"j-1" show the times converted from values of the hand position counter 13*b*; "a-2"-"j-2" show positions of the hands 2, 3, and 4 on the number plate; and "a-3"-"j-3" show sates of the penetration holes 40 and 41. Moreover, in FIGS. 14A-14E, "a-1" - "e-1" show values of the timing counter 13*a*; "a-2" - "e-2" show the times converted from values of the hand position counter 13*b*; "a-3"-"e-3" shows positions of the hands 2, 3, and 4 on the number plate; and "a-4"-"e-4" show states of the penetration holes 40 and 41.

[Hand Shift Check]

The electronic timepiece 1 of this embodiment performs the processing of "hand shift check" once a minute at the time of a normal hand movement displaying time to ascertain whether any delay or abnormal stop of the second hand 2 has arisen or not. The CPU 11 constitutes a detection control section by executing the processing of the processing of the "hand shift check." In the processing of the "hand shift check, " the hand position detection is performed twice at two timings in 60 seconds. That is, the electronic timepiece 1 detects whether the penetration holes 40 and 41 are in the state of overlapping each other at the detection position P by operating the photodetector 20 at the timing of "00" second (first timing), at which the penetration holes 40 and 41 should overlap each other at the detection position P in a normal hand movement, and at the timing of "01" second (second timing), at which the penetration holes 40 and 41 should not overlap each other completely in the normal hand movement.

The hand position examining processing will now be described with reference to the flow charts and the explanatory views. The CPU 11 starts this hand position examining processing (FIGS. 5-7) on the basis of a minute carry (carry in minute digits) of the timing counter 13*a* in a normal hand movement. When the CPU 11 has started this hand position examining processing, the CPU 11, first, moves the hand position examining processing to the processing of the "hand shift check," and, thereby, executes hand shift check once a minute.

When the CPU 11 has moved the hand position examining processing to the processing of the "hand shift check," the CPU 11, first, outputs drive pulses to the stepping motor to execute hand movement processing at the time of the minute carry (Step S1), and successively makes the photodetector 20 operate to judge whether a light passing through the penetration holes 40 and 41 is detected or not (Step S2: hand movement judging section).

If the light is detected as a result, the CPU 11 waits a second carry (carry in second digits) of the timing counter 13*a* (Step S3). When the second carry occurs, the CPU 11 outputs drive pulses to the stepping motor to execute the hand movement processing at 01 sec (Step S4). Successively, the CPU 11 operates the photodetector 20 to judge whether a light passing through the penetration holes 40 and 41 is detected or not (Step S5: hand movement judging section). Because it is normal that no overlapping of the penetration holes 40 and 41 exists at "01" second, if no light is detected here, the CPU 11 regards the state as including no abnormality and ends the hand position examining processing.

FIGS. 8A-8E and FIGS. 9A-9E show the operation of the electronic timepiece 1 at the time of a normal hand movement. The CPU 11 starts the hand position examining processing at the timing of "00" second shown in FIG. 8A "a-1", "a-2", and "a-3", and the CPU 11 performs the detection of the penetration holes 40 and 41 with the photodetector 20 at this timing and the timing of "01" second shown in FIG. 8B "b-1", "b-2", and "b-3". Then, at the timing of "00" second, the penetration holes 40 and 41 overlap each other at the detection position P, and a detection result is detected; and at the time of "01" second, the overlapping of the penetration holes 40 and 41 is removed and the detection result becomes non-detection. The CPU 11 ascertains the normal hand movement of the second hand 2 by this detection pattern, and ends one time of the hand position examining processing.

Figure 8C:
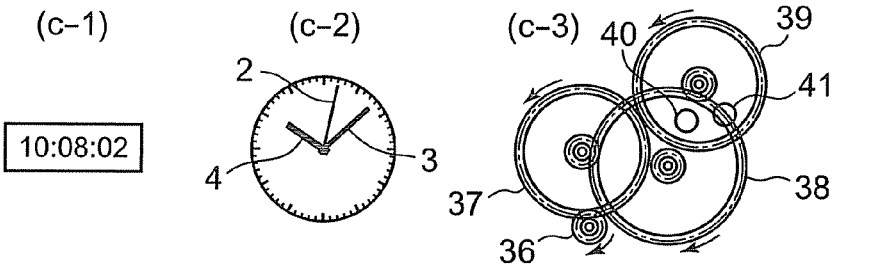
Figure 8D:
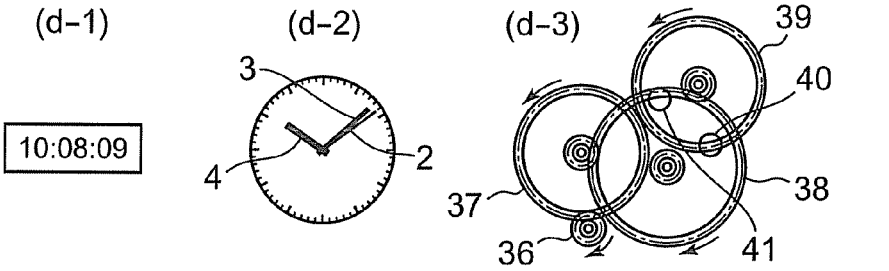
Figure 8E:
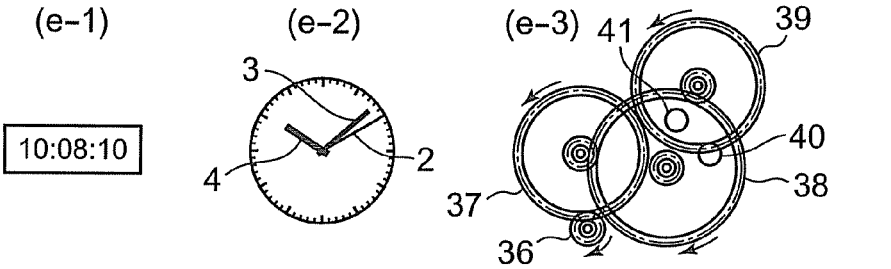
Figure 9A:
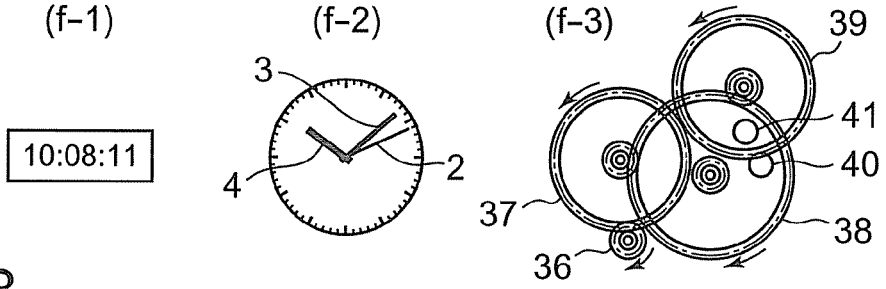
FIGS. 9A, 9B, 9C, 9D, and 9E are a second part of the explanatory views showing the operation of the same hand position examination at the time of the normal hand movement.
Figure 9B:
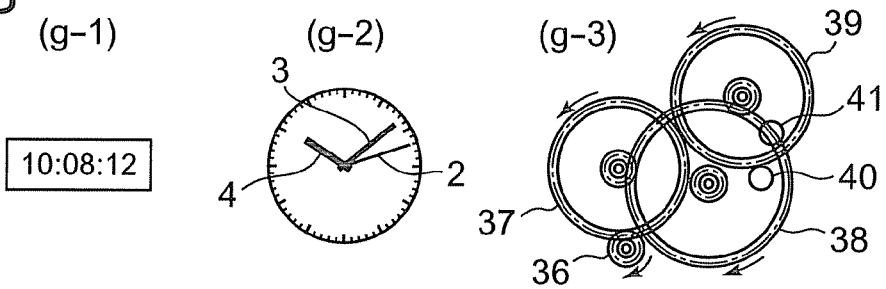
Figure 9C:
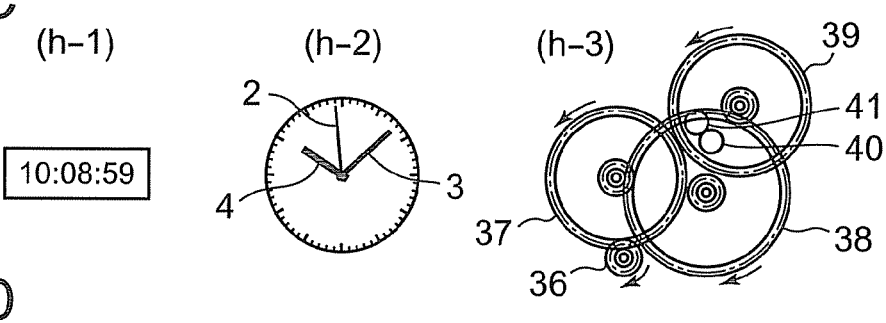
Figure 9D:
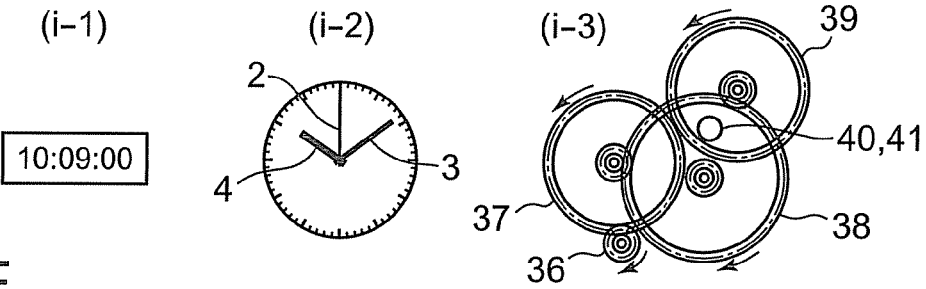
Figure 9E:
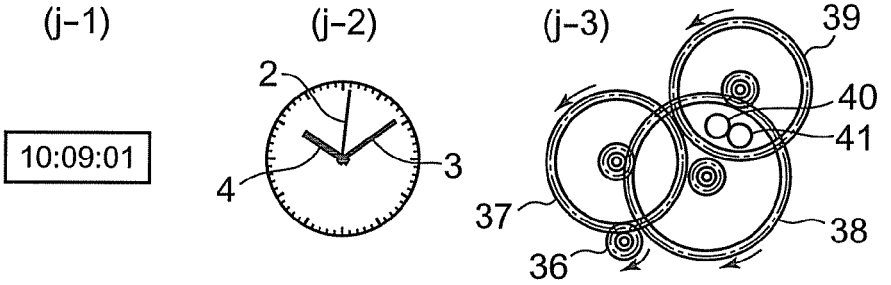

After that, the CPU 11 does not execute the hand position examining processing in the period of from "02" seconds to "59" seconds shown from FIG. 8C "c-1", "c-2", and "c-3" to FIG. 9C "h-1", "h-2", and "h-3", and the CPU 11 similarly executes the hand position examining processing at the timings of "00" second and "01" second shown in FIG. 9D "i-1", "i-2", and "i-3" and FIG. 9E "j-1", "j-2", and "j-3", respectively.

Figure 10:
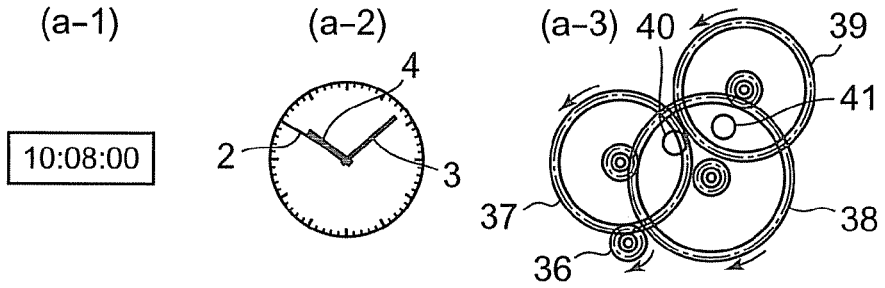
FIG. 10 is an explanatory view showing a state when a hand shift is detected in the hand position examination.

On the other hand, if no light is detected in the light detecting processing (Step S2) at the timing of "00" second in the processing of the "hand shift check" described above, it is possible to judge that the second hand 2 is delayed. For example, FIG. 10 shows the case where the second hand 2 is delayed. In this case, when the value of the hand position counter 13*b* is "00" second, the penetration holes 40 and 41 do not overlap with each other at the detection position P, and consequently the result of the light detecting processing at the "00" second is non-detection, which enables the judgment of a delay of the hand movement.

Accordingly, in this case, the CPU 11 next moves the hand position examining processing to the processing of moving the second hand 2 by fast-forwarding to the position of the "00" second, that is, the processing of "even second position fast-forward check" (first correction control section) from Step S8.

Figure 11A:
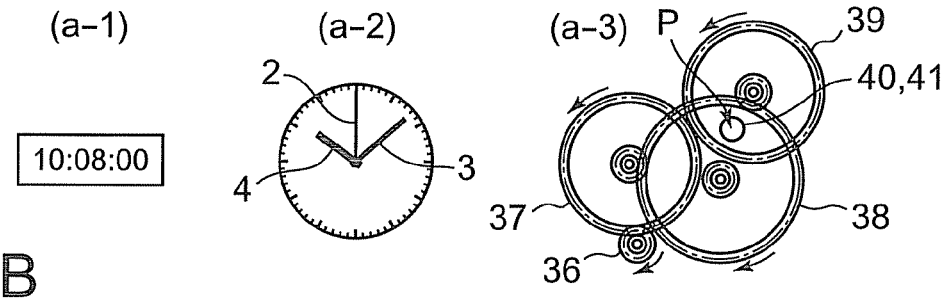
FIGS. 11A and 11B are explanatory views showing a state when the hands abnormally stop at a detection position.
Figure 11B:
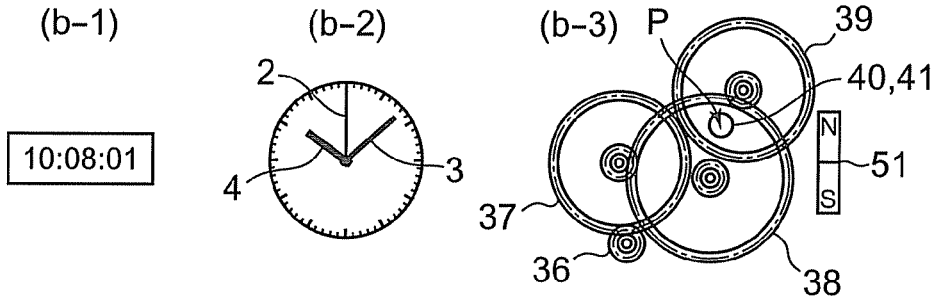

Moreover, if a light is detected in the light detecting processing (Step S5) at the timing of the "01" second after the light has been detected at the timing of the "00" second in the processing of the "hand shift check" described above, it is possible to judge that the second hand 2 has abnormally been stopped at the position of the "00" second. For example, FIGS. 11A and 11B show the case where the drive of the stepping motor has stopped owing to the approaching of a magnet 51 when the second hand 2 has been situated at the position of the "00" second. In this case, the penetration holes 40 and 41 are in the state of overlapping with each other at the detection position P at both of the timings of the values of the hand position counter 13*b* of the "00" second and the "01" second. Consequently, the result of the light detecting processing also at the "01" second indicates light detection, and it is possible to judge that the hand movement has abnormally stopped.

Consequently, in this case, the CPU 11 sets the polarity of the next drive pulse to an even pulse (Step S6) in order to make the value of the hand position counter 13*b* correspond to the position of the present second hand 2, and makes the hand position temporal storage section 13*c* store the value of the hand position counter 13*b* at the present time point (Step S7: counted value saving section) in order to easily correct the value of the hand position counter 13*b* when the normal hand movements of the hands 2, 3, and 4 are next ascertained.

Successively, the CPU 11 moves the hand position examining processing to the processing of "hand movement processing stopping and waiting" (second correction control section) from Step S17 in order not to repeatedly perform useless hand movement processing and useless hand position detection processing owing to abnormal stops of the hand movement.

[Even Number Position Fast-Forward Check]

Next, the processing of the "even second position fast-forward check," to which the hand position examining processing is moved when a delay of the hand movement is detected, will be described. This processing is the processing of outputting drive pulses to the stepping motor up to 60 pulses and of performing hand position detection every output of an even pulse to judge whether the secondhand 2 comes the position of the "00" second or not.

If the hand movement is only temporarily stopped to cause the delay when the delay of the hand movement is detected, the second hand 2 arrives at the position of the "00" second after outputting any one of even pulses by driving the hands 2, 3, and 4 up to 60 steps. Consequently, the state in which the second hand 2 is situated at the position of the "00" second can be found out by making the photodetector 20 operate to perform hand position detection after the outputting of the even pulses. For example, FIG. 13A "a-1", "a-2", and "a-3" to FIG. 13D "d-1", "d-2", "d-3" show an example of this case. As shown in FIGS. 13A-13D, the CPU 11 detects a delay of the hand movement at the timing of the value of the hand position counter 13*b* of "10:08:00" and moves the hand position examining processing to the processing of the "even second position fast-forward check." After that, the CPU 11 repeats outputting odd pulses and even pulses to advance the hands 2, 3, and 4, and performs hand position detection every outputting an even pulse. Then, the CPU 11 judges that the second hand 2 has reached the position of the "00" second at the timing of the value of the hand position counter 13*b* of "10:08:10."

Figure 12A:
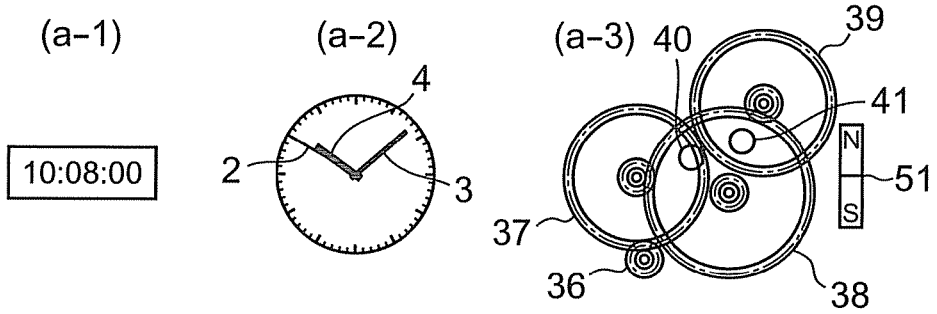
FIGS. 12A and 12B are explanatory views showing a state when an abnormal stop is detected in the hand position examination.
Figure 12B:
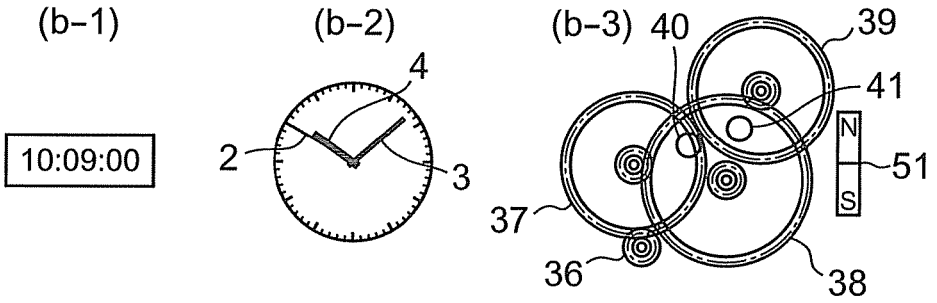

On the other hand, if the hands 2, 3, and 4 are abnormally stopped owing to an external factor such as the magnet 51, the second hand 2 remains in the state of being stopped not to return to the position of the "00" second even if the CPU 11 outputs drive pulses for 60 steps to the stepping motor. Consequently, if the CPU 11 performs the hand position detection every even pulse throughout the outputting period of the drive pulses for 60 steps and obtains the results of non-detection to all the hand position detection, then the CPU 11 can judge that the hands 2, 3, and 4 are abnormally stopped. For example, FIGS. 12A and 12B show an example of this case. In the case of FIGS. 12A and 12B, the CPU 11 detects a delay of the hand movement at the timing of the value of the hand position counter 13*b* of "10:08:00" and moves the hand position examining processing to the processing of the "even second position fast-forward check." After that, the CPU 11 performs hand position detection every outputting an even pulse together with outputting drive pulses, and the CPU 11 is not capable of obtaining the result of light detection even when the value of the hand position counter 13*b* becomes "10:09:00" and judges that the hands 2, 3, and 4 have abnormally been being stopped.

The operation of the "even second position fast-forward check" will now be described with reference to the flow chart of FIG. 6. When the CPU 11 has moved the hand position examining processing to the processing of "even second position fast-forward check," the CPU 11, first, sets the polarity of the next drive pulse to that of an odd pulse (Step S8). Next, the CPU 11 stores the value of the hand position counter 13*b* into the hand position temporal storage section 13*c* (Step S9: counted value saving section) in order to be capable of easily correcting the value of the hand position counter 13*b* when the normal hand movements of the hands 2, 3, and 4 are next ascertained.

Successively, the CPU 11 initializes a variable Hand_Ct for counting the number of output times of the drive pulses to zero (Step S10) and supply the stepping motor with a drive pulse for one step by a fast-forward period (Step S11) to add "1" to the value of the variable Hand_Ct (Step S12). Successively, the CPU 11 judges whether the drive pulse output at Step S11 is an even pulse or not (Step S13), and returns the hand position examining processing to Step S11 if the judged drive pulse is an odd pulse. On the other hand, if the judged drive pulse is an even pulse, the CPU 11 operates the photodetector 20 to detect the penetration holes 40 and 41 (Step S14). If the CPU 11 detects the penetration holes 40 and 41 as a result, the CPU 11 moves the hand position examining processing to the processing of "odd second position check and hand position counter correction" from Step S23. On the other hand, if the CPU 11 does not detect the penetration holes 40 and 41, the CPU 11 ascertains whether the variable Hand_Ct becomes "60" or not (Step S15), and returns the hand position examining processing to Step S11 if the variable Hand_Ct does not become "60."

Moreover, if the CPU 11 judges that the variable Hand_Ct becomes "60" by the judgment processing at Step S15, the CPU 11 can judge that the fact indicates abnormal stops of the hands 2, 3, and 4, and the CPU 11 accordingly moves the hand position examining processing to the processing of "hand movement processing stopping and waiting" from Step S17. By such processing, the processing operation of the "even second position fast-forward check" mentioned above is realized.

[Odd Second Position Check and Hand Position Counter Correction]

Successively, the processing of "odd second position check and hand position counter correction, " to which the hand position examining processing is moved when the hand positions are detected in the processing of the "even second position fast-forward check," will be described. This processing is, as shown in FIGS. 13D "d-1", "d-2", and "d-3" and 13E "e-1", "e-2", and "e-3", the processing of ascertaining whether the second hand 2 is correctly being moved or not by performing the further outputting of the next drive pulse and hand position detection after detecting that the second hand 2 has reached the position of the "00" second, and of correcting the data value of the hand position counter 13*b* if the second hand 2 has correctly been being moved.

The correction of the data value of the hand position counter 13*b* is, here, performed on the basis of the next theory. That is, in this electronic timepiece 1, it is not supposed that the hands 2, 3, and 4 shift in their gaining directions, and it is supposed that the hands 2, 3, and 4 once stop owing to an external factor such as a magnet and the hands 2, 3, and 4 thereby shift into their delaying directions.

Figure 13A:
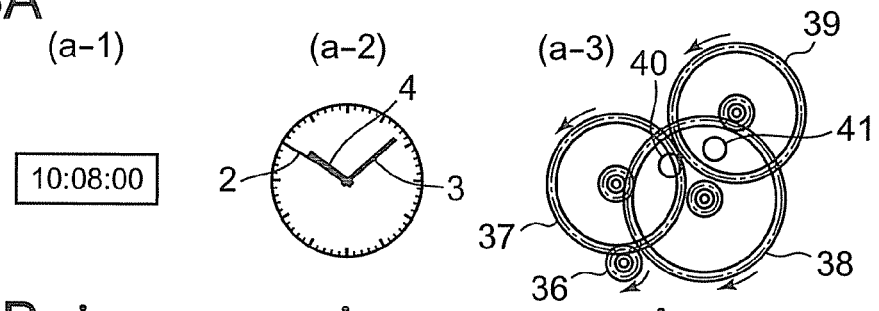
FIGS. 13A, 13B, 13C, 13D, and 13E are explanatory views showing an operation from detection of a hand shift to a correction of the value of a hand position counter.

Consequently, as shown in FIG. 13A "a-1", "a-2", and "a-3", if a positional shift of the second hand 2 is detected in the processing of "hand shift check, " the hands 2, 3, and 4 can be judged that they are situated at positions where the time indicated by them is delayed within one minute from the time indicated by the value of the hand position counter 13*b* at that time point. The reason is that the processing of the "hand shift check" is performed every minute. Then, the value of the hand position counter 13*b* at this time point is stored in the hand position temporal storage section 13*c* by the processing at Steps S7 and S9.

Figure 13B:
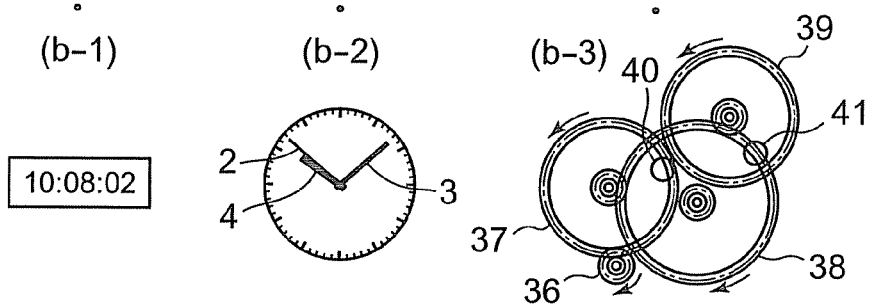
Figure 13C:
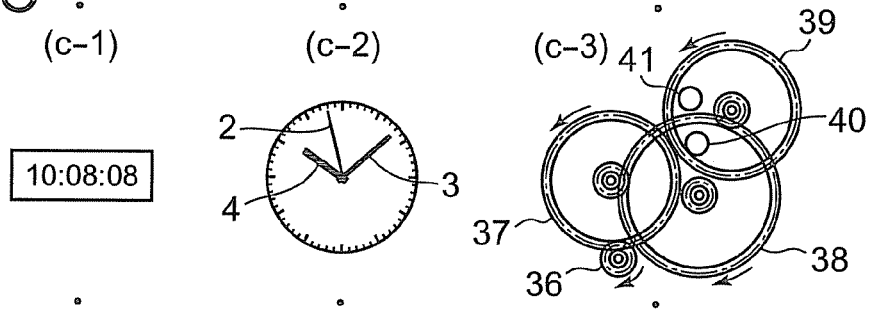
Figure 13D:
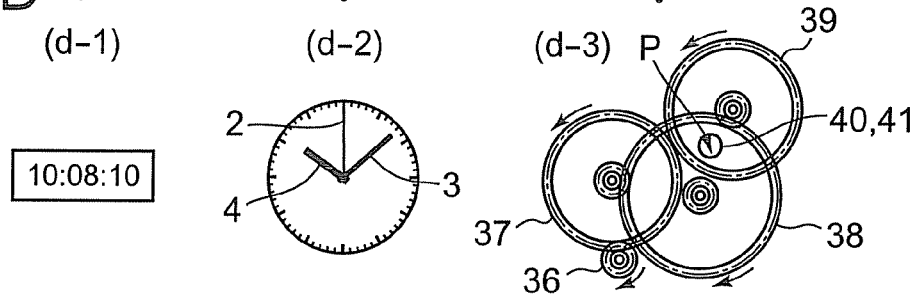

Furthermore, the CPU 11 performs the hand position detection every outputting an even pulse to the stepping motor in the processing of the "even second position fast-forward check" as shown in FIG. 13B "b-1", "b-2", and "b-3" to FIG. 13D "d-1", "d-2", and "d-3" after a positional shift has been detected in the processing of the "hand shift check." Hence, if the CPU 11 cannot obtain any result of light detection in the hand position detection, it can be judged that the second hand 2 has not moved across the "00" second from the shifted state of the hands 2, 3, and 4. Moreover, as shown in FIG. 13D (d-1), (d-2), and (d-3), when the secondhand 2 is next detected at the position of the "00" second, it can be judged that the hands 2, 3, and 4 are situated at the positions indicated by the value of the hand position counter 13*b* when the preceding positional shifts have been detected, i.e., the value of the hand position temporal storage section 13*c*.

Figure 13E:
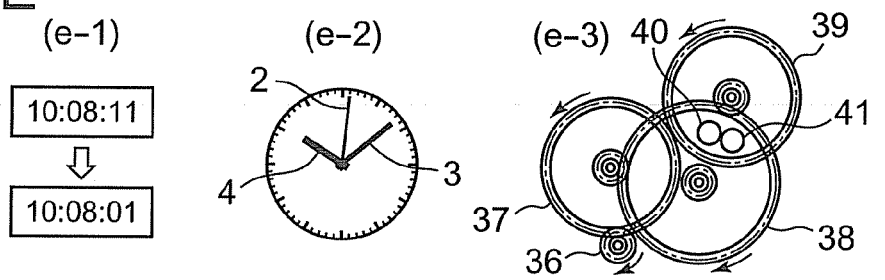

Consequently, as shown in FIG. 13E "e-1", "e-2", and "e-3", if the CPU 11 has output the next odd pulse in the processing of this "odd second position check and hand position counter correction" and has judged that the second hand 2 has advanced the position of the "01" second, then the CPU 11 reads out the value ("10:08:00" in FIG. 13E) of the hand position temporal storage section 13*c*, and changes the value of the second digit to "01." After that, the CPU 11 overwrites the hand position counter 13*b* with this value to correct the hand position counter 13*b*.

The processing of the "odd second position check and hand position counter correction" will now be described with reference to the flow chart of FIG. 7. When the CPU 11 has moved the hand position examining processing to the processing of the "odd second position check and hand position counter correction," the CPU 11, first, outputs a drive pulse for one step to the stepping motor (Step S23), and the CPU 11 next makes the photodetector 20 operate to perform hand position detection (Step S24). If the second hand 2 has moved to the position of the "01" second and the detection result is non-detection as a result, then the CPU 11 can judge that the second hand 2 has been performing a normal hand movement. Consequently, as described above, the CPU 11 corrects the value of the hand position counter 13*b* on the basis of the value of the hand position temporal storage section 13*c* (Step S25: counted value correcting section). Then, the CPU 11 next moves the hand position examining processing to the processing of "fast-forward hand position return."

On the other hand, if the second hand 2 has not moved to the position of the "01" second and the CPU 11 obtains the result of light detection in the hand position detection at Step S24, then the CPU 11 can judge that the second hand 2 has abnormally been stopped at the position of the "00" second. Consequently, the CPU 11 returns the hand position examining processing to Step S6, and after that, the CPU 11 moves the hand position examining processing to the processing of the "hand movement processing stopping and waiting" from Step S17.

[Hand Movement Processing Stopping and Waiting]

Next, the processing of the "hand movement processing stopping and waiting," to which the CPU 11 moves the hand position examining processing when the hands 2, 3, and 4 are abnormally stopped will be described. This processing is the processing of coping with abnormal stops of the hands 2, 3, and 4 owing to an external factor to spontaneously stop hand movement processing and the processing of hand position detection for little while in order not to bring about useless power consumption and of waiting until the next execution of the processing of hand position detection.

After having waited for a predetermined time by the processing of this "hand movement processing stopping and waiting," the CPU 11 again performs the processing of the "even second position fast-forward check" to ascertain whether the abnormal stops of the hands 2, 3, and 4 have been solved or not. Then, if the CPU 11 judges that the abnormal stops are not solved, then the CPU 11 ends up repeatedly executing this processing of the "hand movement processing stopping and waiting."

In this processing of the "hand movement processing stopping and waiting," if the abnormal stops of the hands 2, 3, and 4 are not solved and the CPU 11 repeatedly executes this processing of the "hand movement processing stopping and waiting," the waiting time of this processing is set to gradually lengthen. For example, the waiting time is set to be 5 minutes in a first processing of the "hand movement processing stopping and waiting, 10 minutes in a second processing, 30 minutes in a third processing, 60 minutes in a fourth processing, 120 minutes in a fifth and after processing, and the like.

This processing of the "hand movement processing stopping and waiting" will be described with reference to the flow chart of FIG. 6. When the CPU 11 moves the hand position examining processing to this processing of the "hand movement processing stopping and waiting," the CPU 11, first, performs the setting of a status flag and the like for temporarily stopping hand movements (Step S17), and initializes a variable Wait_Ct for counting a waiting time to zero (Step S18). Successively, the CPU 11 judges whether there is a minute carry (carry in the minute digits) of the timing counter 13*a* or not (Step S19). If there is no minute carry, the CPU 11 repeats the judgment processing until a minute carry occurs. On the other hand, if there is a minute carry, the CPU 11 counts up the variable Wait_Ct (Step S20) and judges whether the variable Wait_Ct reaches a set value X or not (Step S21). The set value X is set to be 5 minutes at a first time. If the processing of the "hand movement processing stopping and waiting" is repeatedly executed, the set value X will be set according to the number of repeated times. For example, if the number of repeated times is two, the set value X will be set to be 10 minutes; if three, then 30 minutes; if four, then 60 minutes; if more than four, then 120 minutes. When the CPU 11 ascertains the solution of a hand shift, the CPU 11 will reset the number of repeated times.

If the variable Wait Ct does not reach the set value X as the result of the judgment processing at Step S21, the CPU 11 returns the hand position examining processing to Step S19. On the other hand, if the variable Wait Ct has reached the set value X, the fact indicates a lapse of the waiting time, and the CPU 11 accordingly performs the setting of a status flag and the like for restarting hand movements and the processing of the hand position detection (Step S22). Then, the CPU 11 sets the polarity of the next drive pulse to an even pulse (Step S16), and moves the hand position examining processing to the processing of the "even second position fast-forward check" from Step S10.

Figure 14A:
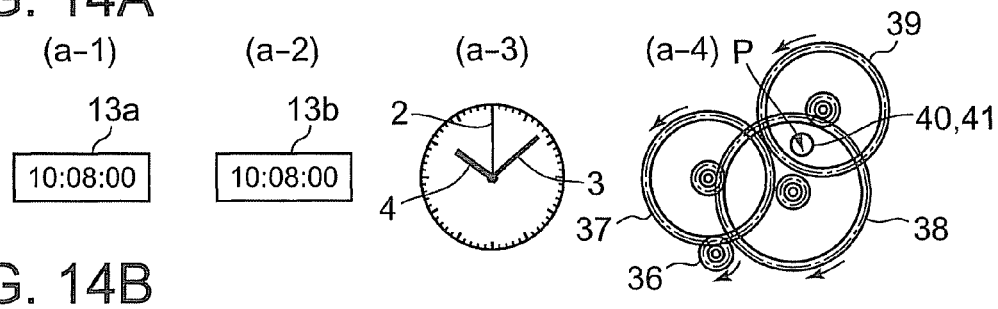
FIGS. 14A, 14B, 14C, 14D, and 14E are explanatory views showing an operation from detection of an abnormal stop of the hands to a correction of the value of the hand position counter.
Figure 14B:
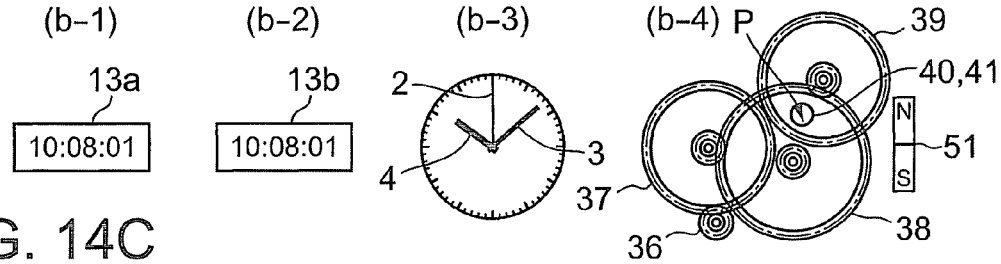
Figure 14C:
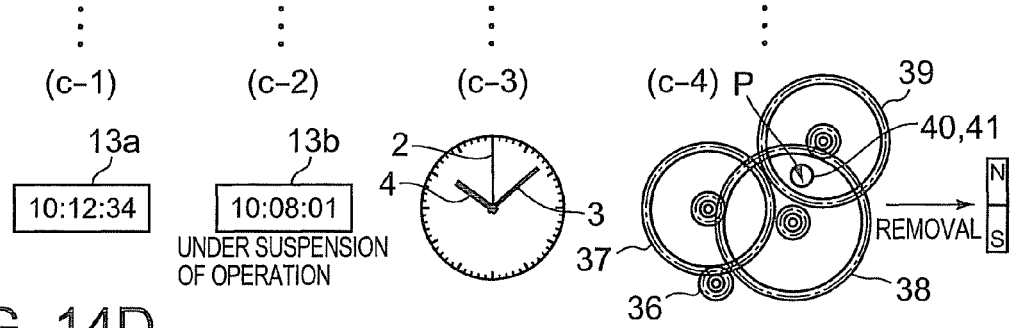
Figure 14D:
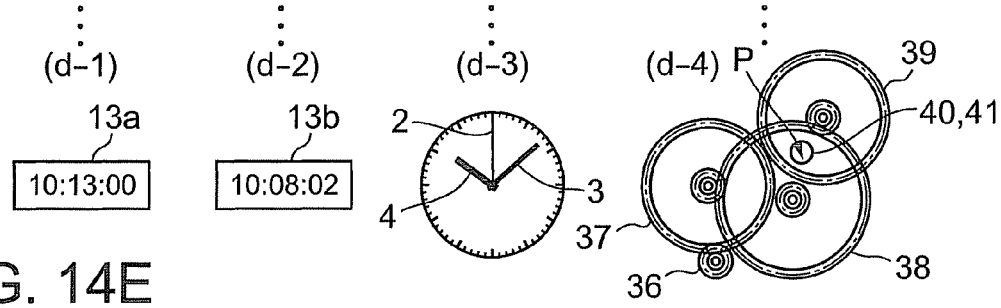

FIGS. 14A-14E show an example of the operation from abnormal stops of the hands 2, 3, and 4 owing to the magnet 51 to the correction of the value of the hand position counter 13*b* through the processing of the "hand movement processing stopping and waiting." As shown in FIGS. 14A-14E, after the CPU 11 has detected the abnormal stops of the hands 2, 3, and 4 by the processing of the "hand shift check" shown in FIG. 14A "a-1", "a-2", "a-3", and "a-4", and FIG. 14B "b-1", "b-2", "b-3", and "b-4", the CPU 11 moves the hand position examining processing to the processing of the "hand movement processing stopping and waiting" for 5 minutes, and the magnet 51 is removed during the waiting processing (FIG. 14C "c-1", "c-2", "c-3", "c-4"). Then, when the waiting processing has ended as shown in FIG. 14D "d-1", "d-2", "d-3", and "d-4", the CPU 11 moves the hand position examining processing to the processing of the "even second position fast-forward check," and outputs an even pulse and performed hand position detection. The CPU 11 thus detects the fact that the second hand 2 is situated at the position of the "00" second.

At the timing of FIG. 14D "d-1", "d-2", "d-3", and "d-4", because the second hand 2 is originally situated at the position of the "00" second, the stepping motor, the first detection wheel 38, the second detection wheel 39, and the second hand 2 do not rotate by the output of the even pulse, and thereby it is detected that the second hand 2 is situated at the position of the "00" second at this time point.

Figure 14E:
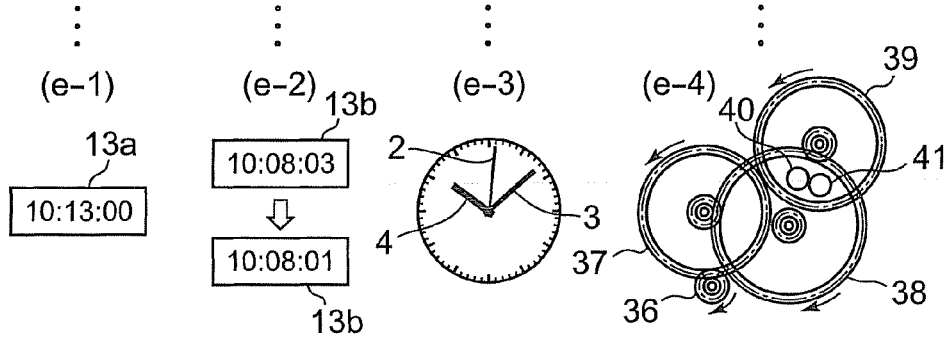

Then, at the timing of FIG. 14E "e-1", "e-2", "e-3", and "e-4", the CPU 11 performs the processing of the "odd second position check and hand position counter correction." When the CPU 11 judges that the overlapping of the penetration holes 40 and 41 to each other is removed and the second hand 2 has moved to the position of the "01" second, and then the CPU 11 corrects the data value of the hand position counter 13*b* on the basis of the data value stored in the hand position temporal storage section 13*c* at the time of detecting the abnormal stops of the hands 2, 3, and 4. The method of the correction of the data value is the same as that described above.

[Fast-Forward Hand Position Return]

Next, the processing of "fast-forward hand position return," to which the CPU 11 moves the hand position examining processing when the CPU 11 has corrected the data value of the hand position counter 13*b*. The processing of the "fast-forward hand position return" is the processing performing fast-forward hand movements of the hands 2, 3, and 4 to adjust the position data of the hands 2, 3, and 4 shown by the hand position counter 13*b* to the time data shown by the timing counter 13*a*. By the processing, the positional shifts of the hands 2, 3, and 4 from the present time are solved, and the present time shown by the timing counter 13*a* ends up being displayed with the plurality of hands 2, 3, and 4.

The CPU 11 is also configured as follows: when the CPU 11 performs the fast-forward hand movements of the hands 2, 3, and 4 by the processing of the "fast-forward hand position return," the CPU 11 performs hand position detection at the timing when the second hand 2 arrives at the position of the "00" second and the timing when the second hand 2 arrives at the position of the "01" second to ascertain whether the hand movement is normally being performed or not similarly to the processing of the "hand shift check."

The processing of the "fast-forward hand position return" will be described with reference to the flow chart of FIG. 7. When the CPU 11 has moved the hand position examining processing to the processing of the "fast-forward hand position return," the CPU 11 compares the value of the timing counter 13*a* to that of the hand position counter 13*b* to judge whether the positions of the present hands 2, 3, and 4 agree with the present time (Step S26). If the both agree with each other as the result, it can be judged that the hands 2, 3, and 4 has moved to the positions of the present time and the correction has been completed, and the CPU 11 accordingly ends this hand position examining processing.

On the other hand, if the both do not agree with each other, the CPU 11 supplies the stepping motor with drive pulses at the period of a fast-forward (Step S27). Next, the CPU 11 judges whether it is the timing when the second hand 2 is supposed to be situated at the position of the "00" second or not on the basis of the data value of the hand position counter 13*b* (Step S28).

If the timing is not that of the "00" second as the result, the CPU 11 returns the hand position examining processing to Step S26. On the other hand, if the timing is that of the "00" second, the CPU 11 operates the photodetector 20 to perform hand position detection for detecting the overlapping of the penetration holes 40 and 41 to each other (Step S29). Then, if the overlapping is not detected as the result, the CPU 11 judges that a hand shift has again occurred and consequently jumps the hand position examining processing to the processing of the "even second position fast-forward check" from Step S8 again.

Moreover, if the detection result at Step S29 is light detection, the CPU 11 judges whether the present positions of the hands 2, 3, and 4 agree with the present time or not (Step S30), and ends the hand position examining processing as it is if the both agree with each other. On the other hand, if the both do not agree with each other, the CPU 11, first, performs hand movement processing of one step in a fast-forward period to advance the second hand 2 to the position of the "01" second (Step S31). Next, the CPU 11 performs hand position detection for ascertaining whether the second hand 2 has reached the position of the "01" second or not (Step S32). If the detection result is non-detection, the CPU 11 judges that the second hand 2 has normally moved to return the hand position examining processing to Step S26. On the other hand, if the detection result is light detection, the CPU 11 judges that the second hand 2 has abnormally been stopped at the position of the "00" second, and performs the processing at Steps S6 and S7. After that, the CPU 11 moves the hand position examining processing to the processing of the "hand movement processing stopping and waiting."

If normal hand movements have been performed by the aforesaid loop processing at Steps S26-S28 or Steps S26-S32, the CPU 11 moves the plurality of hands 2, 3, and 4 to the positions indicating the present time by a fast-forward, and ends the hand position examining processing.

As described above, the electronic timepiece 1 of this embodiment is configured as follows: the CPU 11 executes the hand position examining processing every one minute for which the second hand 2 makes one revolution, and performs hand position detection at the timing of the "00" second, at which the overlapping of the penetration holes 40 and 41 to each other appears at the detection position P, and the timing of the "01" second, at which the overlapping of the penetration holes 40 and 41 to each other disappears at the detection position P, to examine whether the second hand 2, the minute hand 3, and the hour hand 4 are normally moving or not. The electronic timepiece 1 is consequently configured to be capable of discovering a delay and an abnormal stop of the second hand 2 in a short time within one minute or the like to cope with those accidents.

Moreover, because the electronic timepiece 1 performs hand position detection at the two timings mentioned above, the electronic timepiece 1 is configured to be capable of detecting not only the case where the second hand 2 is temporarily stopped to be delayed but also the case where the second hand 2 is abnormally stopped at the detection position. Furthermore, when normal hand movements are being performed, the electronic timepiece 1 performs the operation of hand position detection only twice for one minute, and consequently the generation of excessive power consumption can be prevented by minimum necessary hand position detection.

Moreover, because the electronic timepiece 1 of this embodiment is configured in such a way that the first detection wheel 38 rotates in the same period as that of the second hand wheel 31, and that the state in which the second hand 2 is situated at a predetermined position (for example, the position of the "00" second) can be detected, the timing at which hand position examination is performed is easily, set by, for example, synchronizing the timing to that at which a minute carry arises. Moreover, the electronic timepiece 1 is configured to make it easy to specify the position of the second hand 2 at the time of correcting a hand shift.

Moreover, the electronic timepiece 1 of this embodiment is configured in such a way that the overlapping of the penetration holes 40 and 41 to each other appears at the detection position P when the second hand 2 is situated at the detection position (for example, the position of the "00" second), and that the overlapping of the penetration holes 40 and 41 to each other is hidden at the detection position P when the second hand 2 is situated at the step positions before and after the detection position P. Furthermore, the electronic timepiece 1 is configured to perform hand position detection at successive two steps including the step at which the second hand 2 comes to the detection position (the position of the "00" second) and the next step thereof. Consequently, the electronic timepiece 1 can surely and rapidly examine the states of hand positional shifts and hand abnormal stops.

Moreover, the electronic timepiece 1 of this embodiment is configured in such a way that the CPU 11 moves hand position examining processing to the processing of the "even second position fast-forward check" for correcting hand shifts at the time of obtaining the result of non-detection in hand position detection at the "00" second, and that the CPU 11 moves the hand position examining processing to the processing of the "hand movement processing stopping and waiting" for coping with abnormal stops of the hands 2, 3, and 4 at the time of obtaining the result of light detection in the hand position detection at both of the "00" second and the "01" second. The electronic timepiece 1 can consequently perform the processing suitable for each of the cases where delays of the hands 2, 3, and 4 are detected and where abnormal stops of the hands 2, 3, and 4 are detected.

Moreover, the electronic timepiece 1 of this embodiment is configured to form the penetration holes 40 and 41 in the first and second detection wheels 38 and 39, respectively, and to detect whether the second hand 2 is situated at the detection position (the position of the "00" second) or not by detecting the overlapping of the penetration holes 40 and 41 to each other with the photodetector 20, and consequently surer hand position detection is realized by this configuration.

Incidentally, the present invention is not limited to the embodiment described above, but can variously be changed.

For example, although the embodiment described above is configured to rotate the first detection wheel 38 once by 60 steps similarly to that of the second hand 2, the first detection wheel 38 may be configured to rotate once by 30 steps or 120 steps, and the electronic timepiece 1 can also be configured in such a way that the hand position examining processing and the position detection of the second hand 2 are performed in a 30-second period or a 2-minute period.

Moreover, although the embodiment is configured to perform hand position detection by successive two steps including the step of the "00" second and the step of the "01" second for ascertaining the normal hand movement of the second hand 2, for example, it is also possible to perform hand position detection at two even steps including the step of the "00" second and the step of "02" second for ascertaining the normal hand movement of the second hand 2.

Moreover, although the embodiment described above forms the section to be detected as the penetration hole 40 to detect the penetration hole 40 with the photointerrupter type photodetector 20, it is also possible to configure the section to be detected to form it as a reflecting section to be detected with a photoreflector type photodetector. In addition, the details shown in the embodiment can suitably be changed without departing from the sprit and the scope of the present invention.

As described above, the electronic timepiece 1 of this embodiment is configured in such a way that the data value of the hand position counter 13*b* is once stored in the hand position temporal storage section 13*c* when a delay or an abnormal stop of the second hand 2 is detected, and that the value of the hand position counter 13*b* is suitably corrected on the basis of the data value in the hand position temporal storage section 13*c* when a normal hand movement of the second hand 2 is next ascertained. Consequently, for example, even if the electronic timepiece 1 is left as it is in the neighborhood of a strong magnet for a long period, the electronic timepiece 1 does not count the stopped period of the second hand 2 for correcting the data value of the hand position counter 13*b* after that, and such a disadvantage that the counter overflows to make it impossible to correctly correct the data value of the hand position counter 13*b* is consequently not caused. Hence, it is unnecessary to prepare a counter having a large number of bits for counting the stopped period of the second hand 2, and it is sufficient to prepare the hand position temporal storage section 13*c* having a capacity enabling the temporal storage of only the values of the digits of hours and minutes among the data values of the hand position counter 13*b*. For example, if the invention is applied to a wrist watch, it is needed to make the capacity of the RAM 13 small at the requests of the circuit area thereof and the reduction of the power consumption thereof, and consequently the feature of the invention that can reduce the necessary capacity of the RAM 13 is especially useful.

Moreover, the electronic timepiece 1 of this embodiment is configured in such a way that hand position detection is executed at the timing at which the second hand 2 reaches the position of the "00" second position and the timing at which the second hand 2 reaches the position of the "01" second at the time of a normal hand movement, and that hand position detection is executed every output of an even pulse to the stepping motor with waiting processing put between the executions thereof after the judgment of the existence of a delay or an abnormal stop of the second hand 2. Consequently, it is difficult to cause the situation in which the passing of the second hand 2 through the detection position is overlooked, and it hence becomes possible to correctly correct the hand position counter 13*b* by the use of the data value of the hand position temporal storage section 13*c* as described above.

Moreover, the hand position temporal storage section 13*c* stores the counted values at the timings at which it is supposed that the second hand 2 reaches the positions of the "00" second and the "01" second at the time of ascertaining a delay or an abnormal stop of the second hand 2. Then, the electronic timepiece 1 corrects the data value of the hand position counter 13*b* at the timing of ascertaining that the second hand 2 has moved to the position of the "01" second through the position of the "00" second after outputting drive pulses for fast forwarding the hands 2, 3, and 4 or inserting waiting processing. Consequently, the data value of the hand position counter 13*b* can correctly be corrected by correcting the values of the second digits among the data values stored in the hand position temporal storage section 13*c* for hand movements and overwriting the data values of the hand position counter 13*b* with those after this correction.

Moreover, the electronic timepiece 1 of this embodiment drives three hands (second hand 2, minute hand 3, and hour hand 4) in conjunction with one another with one stepping motor, and stores the data values showing the positions of the three hands (second hand 2, minute hand 3, and hour hand 4) in the hand position counter 13*b*. Then, the electronic timepiece 1 is configured to be capable of correctly correcting the position data of the three hands (second hand 2, minute hand 3, and hour hand 4) by the correction processing of the hand position counter 13*b* using the hand position temporal storage section 13*c* even if a delay or an abnormal stop of hand movements is temporarily caused.

Incidentally, the present invention is not limited to the embodiment described above, and can variously be changed. For example, although the hand position counter 13*b* is exemplified as a software counter provided in the RAM 13 to perform counting by the processing of the CPU 11 in the embodiment described above, the software counter may be exchanged with a hardware counter. Moreover, because the values of the hand position counter 13*b* are corrected when the second hand 2 has moved to the position of the "01" second in the embodiment described above, it has been described that the values of the second digits of the data values of the hand position temporal storage section 13*c* are corrected to "01" to be used for the correction. However, if the detection position of the second hand 2 is changed or the like, the correction method of the data values of the hand position temporal storage section 13*c* is also suitably changed in response to the change of the detection position.

Moreover, because the embodiment described above is configured in such a way that the stepping motor performs the rotations of even steps and odd steps according to the polarities of drive pulses, the embodiment is configured to ascertain the appearance of the second hand 2 to the detection position by performing the hand position detection every two steps (every output of an even pulse) after the detection of a delay of the second hand 2, but the appearance of the second hand 2 to the detection point may be ascertained by performing the hand position detection every step.

Moreover, although the configuration of driving the second hand 2, the minute hand 3, and the hour hand 4 in conjunction with one another with one stepping motor has been exemplified in the embodiment described above, the present invention can similarly be applied to an electronic timepiece of the type of driving the second hand 2 and the minute hand 3 in conjunction with each other and driving the hour hand 4 independently. In this case, the hand positions of the second hand 2 and the minute hand 3 are counted by the hand position counter 13*b*, and the data values of the hand position counter 13*b* showing the hand positions of the second hand 2 and the minute hand 3 can be corrected by the use of the data values of the hand position temporal storage section 13*c* when a delay or an abnormal stop of the second hand 2 had been detected and the position detection of the second hand 2 has been performed after that.

What is claimed is:

1. An electronic timepiece, comprising:

a second hand and a minute hand;

a stepping motor which performs a stepping drive of the second hand and the minute hand in conjunction with each other;

a rotating body which includes a target section, and rotates in conjunction with the second hand in a rotation period equal to a rotation period of the second hand;

a detection section which detects an existence of the target section at a predetermined detection position;

a detection control section which makes the detection section operate by every rotation period of the rotating body, so as to make the detection section detect the existence of the target section at a first timing and at a second timing which is different from the first timing;

a hand position counter which counts estimated positions of the second hand and the minute hand based on the number of drive times of the stepping motor;

a counted value holding section capable of temporarily holding value information of a value of the estimated positions counted by the hand position counter;

a counted value saving section which makes the counted value holding section hold the value information associated with the value the estimated positions counted by the hand position counter when the detection control section detects that the second hand is not normally rotating; and a counted value correcting section which corrects the value information of the estimated positions counted by the hand position counter based on the value information held in the counted value holding section, when the rotation of the second hand is detected with the detection control section after the detection control section detects that the second hand is not normally rotating; and wherein said counting value saving section has more bits than the value holding section.

2. The electronic timepiece according to claim 1, further comprising:

a hand movement judging section which judges that hand movements of the second hand and the minute hand are normal when the target section is detected at the first timing and when the target section is not detected at the second timing, and further judges that the hand movements of the second hand and the minute hand are abnormal when the target section is not detected at the first timing or when the target section is detected at both of the first timing and the second timing.

3. The electronic timepiece according to claim 1, wherein the detection control section makes the detection section operate by every minute to detect the existence of the target section at the first timing and at the second timing.

4. The electronic timepiece according to claim 1, wherein the target section of the rotating body is configured to appear at the detection position when the second hand is situated at a position of a predetermined step, and to hide from the detection position when the second hand is situated at positions of steps before and after the predetermined step, and the detection control section makes the detection section detect the existence of the target section at a timing at which the second hand is supposed to be situated at the position of the predetermined step and a timing at which the second hand is supposed to be situated at a next step position of the predetermined step as the first timing and the second timing, respectively.

5. The electronic timepiece according to claim 1, further comprising:

a first correction control section which executes processing for correcting delays of the second hand and the minute hand when the target section is not detected at the first timing; and a second correction control section which executes processing of coping with stops of the second hand and the minute hand owing to an external factor when the target section is detected at both the first timing and the second timing.

6. The electronic timepiece according to claim 1, wherein the rotating body is a gear rotating in conjunction with the second hand, the target section is a penetration hole formed in the gear, and the detection section includes: a light emitting section which radiates a light from one side of the gear; and a light receiving section which receives the light from the light emitting section, the light having passed through the penetration hole when the penetration hole is situated at the detection position.

7. The electronic timepiece according to claim 1, wherein the detection control section ascertains whether the second hand has passed through the detection position or not by making the detection section detect a position of the second hand at timings at which the second hand is estimated to be situated at the detection position and a position near the detection position, when the hand movements are normal, and further ascertains whether the second hand has passed through the detection position or not by making the detection section detect the position of the second hand every time when the second hand is driven by either one step or two steps, when it is detected that the second hand has not passed through the detection position.

8. The electronic timepiece according to claim 7, wherein the counted value correcting section performs a correction of the value held in the counted value holding section by the number of steps of which the second hand has passed through the detection position at the timing at which the second hand is detected to pass through the detection position, so as to correct the value of the hand position counter.

9. The electronic timepiece according to claim 1, wherein the stepping motor is configured to perform the stepping drive of the second hand, the minute hand, and an hour hand in conjunction with one another, the hand position counter counts the estimated positions of the second hand, the minute hand, and the hour hand, and the counted value correcting section corrects the values showing the estimated positions of the second hand, the minute hand, and the hour hand.

* * * * *